US010900187B1

(12) United States Patent
Gadh et al.

(10) Patent No.: US 10,900,187 B1
(45) Date of Patent: Jan. 26, 2021

(54) APPARATUS AND METHOD FOR AGGREGATE COLLECTION

(71) Applicant: Honda Motor Co., Ltd., Tokyo (JP)

(72) Inventors: Varun Mangal Gadh, Los Angeles, CA (US); Robert Rangel, Huntington Beach, CA (US); Christopher Yee, Redondo Beach, CA (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/577,115

(22) Filed: Sep. 20, 2019

(51) Int. Cl.
*E02B 15/04* (2006.01)
*E02B 15/10* (2006.01)

(52) U.S. Cl.
CPC ..... *E02B 15/045* (2013.01); *E02B 15/048* (2013.01); *E02B 15/106* (2013.01)

(58) Field of Classification Search
CPC ... E04H 4/1636; E02B 15/045; E02B 15/106; E02B 15/048
USPC ..... 210/242.3
See application file for complete search history.

(56) References Cited

U.S. PATENT DOCUMENTS 4,686,728 A * 8/1987 Rawlins ..... E04H 4/1645 15/1.7
7,504,028 B1 * 3/2009 Gurfinkel ..... B01D 21/245 210/170.11
10,046,983 B2 8/2018 De Luca
2011/0284087 A1 * 11/2011 Vodyanoy ..... E02B 15/106 137/1
2014/0014565 A1 * 1/2014 Qin ..... B01D 17/0208 210/242.4
2017/0043966 A1 * 2/2017 Witelson ..... B01D 33/06

FOREIGN PATENT DOCUMENTS

CN 203358829 U 12/2013
CN 203361112 U 12/2013
CN 103452084 B * 1/2015 ..... E02B 15/10
CN 204185837 U 3/2015
CN 103452084 B 7/2015
CN 206394829 U 8/2017
CN 107401150 A 11/2017
CN 207191329 U 4/2018
(Continued)

OTHER PUBLICATIONS

Mariel Myers, "Seabins Want to be the Garbage Cans of the Ocean", https://www.cnet.com/news/galaxy-fold-samsung-will-relaunch-the-foldable-phone-in-september/, Jan. 29, 2018, 04 pages.

*Primary Examiner* — Nam X Nguyen
*Assistant Examiner* — Ekandra S. Miller-Cruz
(74) *Attorney, Agent, or Firm* — American Honda Motor Co., Inc.; Aaron C. Fong

(57) ABSTRACT

An apparatus and a method for aggregate collection from a water body are provided. The apparatus includes a floatable structure which includes a body having a substantially spherical surface and a storage space within the body. The floatable structure further includes an opening that forms a passage to the storage space. The apparatus further includes a control assembly coupled to the body. The control assembly controls a collection of an aggregate present in the water body, into the storage space through the opening. The collection is controlled when the floatable structure is at least partially immersed in the water body.

18 Claims, 6 Drawing Sheets

(56) References Cited

FOREIGN PATENT DOCUMENTS

| | | | | | |
|---|---|---|---|---|---|
| CN | 108385634 | A | | 8/2018 | |
| CN | 108894196 | A | * | 11/2018 | ..... E02B 15/10 |
| CN | 108894196 | A | | 11/2018 | |
| DE | 19951436 | A1 | | 5/2000 | |
| GB | 2569788 | B | * | 3/2019 | ..... E02B 15/10 |
| KR | 10-1263107 | B1 | | 5/2013 | |
| RU | 2032796 | C1 | | 4/1995 | |
| WO | WO-2012064640 | A1 | * | 5/2012 | ..... B63B 35/00 |
| WO | 2018009116 | A1 | | 1/2018 | |
| WO | 2018009117 | A1 | | 1/2018 | |

* cited by examiner

APPARATUS AND METHOD FOR AGGREGATE COLLECTION

BACKGROUND

Various human activities have resulted in oceans and rivers being polluted with different man-made pollutants, such as pesticides, herbicides, chemical fertilizers, detergents, oil, sewage, plastics, glass, metal, and other solids. Of all the pollutants, solid pollutants, especially plastics typically biodegrade after a long time (e.g., ~1000 years) and are usually found in various sizes (from micro-plastics to plastic-products). As a result, these solid pollutants pose an imminent harm to marine ecosystem, especially to the marine life and biodiversity on earth.

Limitations and disadvantages of conventional and traditional approaches to solve aforementioned problem(s) will become apparent to one of skill in the art, through comparison of described systems with some aspects of the present disclosure, as set forth in the remainder of the present application and with reference to the drawings.

SUMMARY

An exemplary aspect of the disclosure provides an apparatus for aggregate collection from a water body. The apparatus may include a floatable structure that may be configured to be disposed in a water body. The floatable structure may include a body having a substantially spherical surface and a storage space within the body. The floatable structure may further include an opening in the body and such an opening may be configured to form a passage to the storage space. The apparatus may further include a control assembly coupled to the body. The control assembly may be configured to control a collection of an aggregate present in the water body, into the storage space through the opening. The collection may be controlled when the floatable structure is at least partially immersed in the water body.

Another exemplary aspect of the disclosure provides a method for aggregate collection from a water body. The method may include disposing a floatable structure in the water body. The floatable structure may include a body having a substantially spherical surface and a storage space within the substantially spherical surface. The floatable structure may further include an opening on the body. Such an opening may be configured to form a passage to the storage space. The method may further include controlling a collection of an aggregate present in the water body, into the storage space through the opening. Such a collection may be controlled when the floatable structure is at least partially immersed in the water body.

This summary is provided to introduce a selection of concepts in a simplified form that are further disclosed in the detailed description of the present disclosure. This summary is not intended to identify key or essential inventive concepts of the claimed subject matter, nor is it intended for determining the scope of the claimed subject matter.

Figure 1:
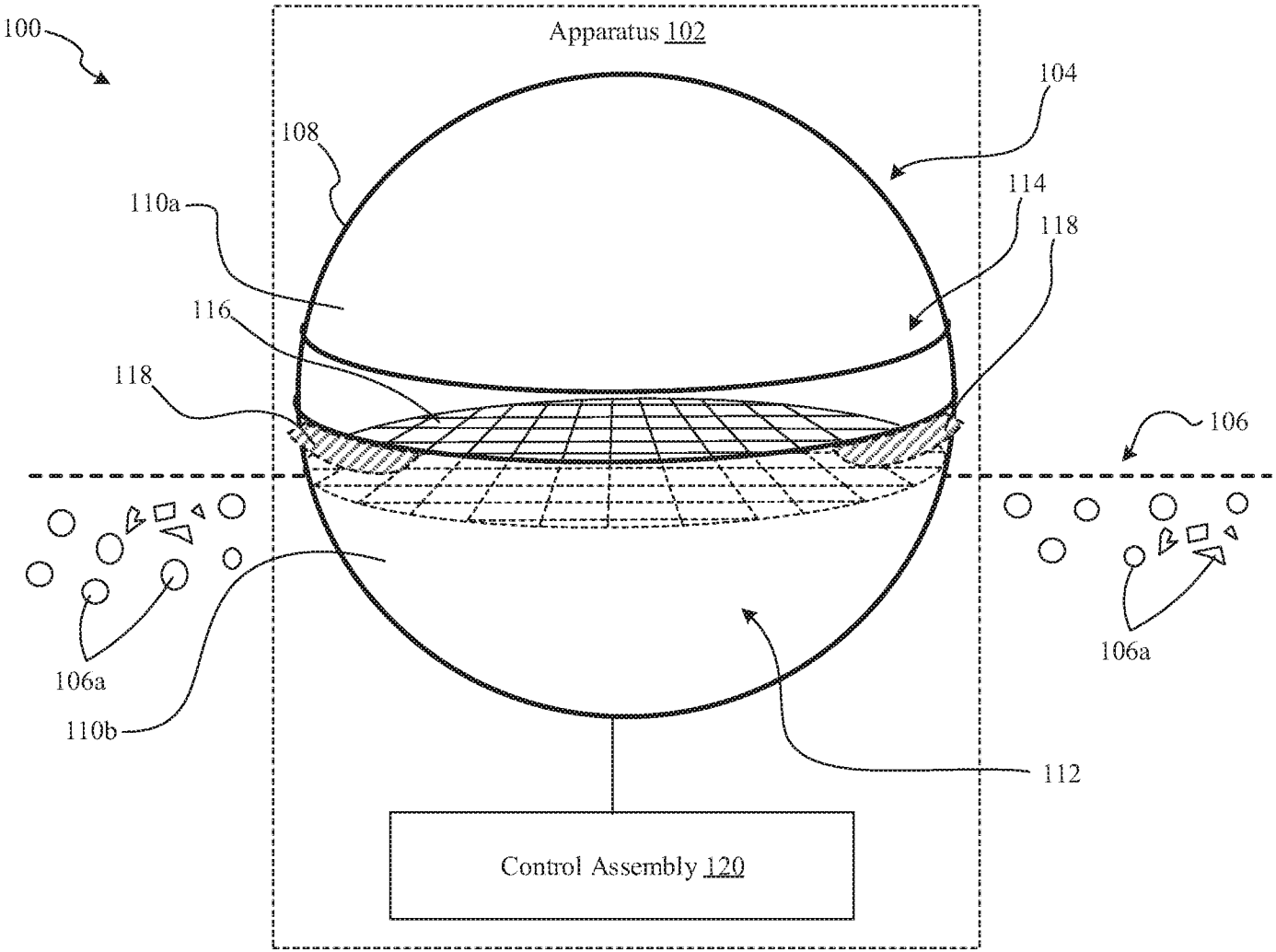
FIG. 1 is a diagram that illustrates an exemplary apparatus for collection of aggregate from a water body, in accordance with an embodiment of the disclosure.

The foregoing summary, as well as the following detailed description of the present disclosure, is better understood when read in conjunction with the appended drawings. For the purpose of illustrating the present disclosure, exemplary constructions of the preferred embodiment are shown in the drawings. However, the present disclosure is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION

The following described implementations may be found in a disclosed apparatus for collection of aggregate(s), for example, plastic aggregates, from a water body. Exemplary aspects of the disclosure provide an apparatus that includes a floatable structure for collection and storage of aggregate(s) in vicinity or in contact with the floatable structure. Additionally, the apparatus includes a control assembly to attract the aggregate inside the floatable structure and/or to separate the aggregate from the water. The aggregate may accumulate around the body of the floatable structure and may be sucked inside into a storage space, via an opening in the body of the floatable structure. In certain instances, the disclosed apparatus may include one or more actuators which may allow the floatable structure to move (rotate and/or translate) as per a set pick-path. With the help of an anchor, the movement of the floatable structure may be restricted to a specific radius, where there may be a higher likelihood of collection of the aggregate. The collected aggregate may be removed from the floatable structure to be compacted or melted down into pellets, which may be used for several applications. In certain instances, the pellets may be melted down on a drilling rig installed in the water body. The melted pellets may be injected inside a hole dug in the bed of the water body by the drilling rig and left to decompose on its own.

Reference will now be made in detail to specific aspects or features, examples of which are illustrated in the accompanying drawings. Wherever possible, corresponding or similar reference numbers will be used throughout the drawings to refer to the same or corresponding parts.

FIG. 1 is a diagram that illustrates an exemplary apparatus for collection of aggregate from a water body, in accordance with an embodiment of the disclosure. With reference to FIG. 1, there is shown an exemplary diagram 100 of an apparatus 102. The apparatus 102 may include a floatable structure 104 which may be configured to be at least partially immersed in a water body 106. Solid objects, especially objects which float on the surface of the water body 106 or at least stay below but near the surface, may be present in the water body 106. These solid objects may be accumulate at times to form an aggregate 106*a* which may be appear as a patch on the surface of the water body 106.

The floatable structure 104 may include a body 108 having a substantially spherical surface. The body 108 may include a first hemispherical portion 110*a* and a second hemispherical portion 110*b*. The first hemispherical portion 110*a* may be coupled to the second hemispherical portion 110*b* so as to form the substantially spherical surface of the body 108. The body 108 may further include a storage space 112 within the body 108 and an opening 114 in the body 108.

The storage space 112 may be configured to accommodate the aggregate 106*a* collected from the water body 106. Additionally, in certain instances, the storage space 112 may accommodate other components such as, but not limited to, a battery, a suction pump (not shown), or an ejection pump (not shown), a propeller (not shown), and/or a communication unit (not shown). The suction pump may, for example, pull-in a portion of the aggregate 106*a* accumulated in the water body 106 inside the storage space 112, through the opening 114. Similarly, the ejection pump may be configured to push-out additional water that may be pulled in along with the portion of the aggregate 106*a* to the storage space 112. This may be performed so as to create space to collect remaining portions of the aggregate 106*a* and also to ensure that the floatable structure 104 stays afloat.

The opening 114 may be a cut-out portion of the body 108 and may be configured to form a passage for the aggregate 106*a* to enter into the storage space 112. In FIG. 1, the opening 114 is shown to be of an arc-shape between the first hemispherical portion 110*a* and the second hemispherical portion 110*b* of the body 108. However, the disclosure may not be so limiting and in some embodiments, the opening 114 on the body 108 may be of any suitable shape and size, and the position of the opening 114 on the body 108 may be different from that shown in FIG. 1, without a deviation from the scope of the disclosure. As an example, the opening 114 may be a slit formed in the body 108.

In at least one embodiment, the floatable structure 104 may include a filter structure 116. The filter structure 116 may be configured to extend circumferentially in the storage space 112 so as to partition the storage space 112 into at least two compartments, such as a first compartment exposed to the opening 114 and a second compartment enclosed by the filter structure 116 and a portion of the body 108. When the aggregate 106*a* is pulled inside through the opening 114, the filter structure 116 may be configured to separate the aggregate 106*a* from the water that comes along with the aggregate 106*a* from the water body 106. As an example, while the aggregate 106*a* may stay on top of the filter structure 116 in the first compartment, water may be collected into the second compartment and removed via an ejection mechanism. In FIG. 1, the filter structure 116 is shown to be disposed below the level of the opening 114. However, the disclosure may not be so limiting and in some embodiments, the filter structure 116 may be disposed at any suitable location in the body 108.

The filter structure 116 may be a selective barrier, for example, a mesh with a particular mesh size to selectively segregate the aggregate 106*a* from the water. The mesh with a particular mesh size may be selected based on a size range of the aggregate 106*a*. Alternatively, the filter structure 116 may include a membrane for microfiltration of fine (e.g., 0.08-2 micrometer ((μm)) as wells as coarse size of individual components of the aggregate 106*a*. As an example, the filter structure 116 may be a semi-permeable membrane that filters out micro plastics (size <5 mm) from the water. Examples of the filter structure 116 may include, but is not limited to, a semi-permeable membrane, a selectively permeable membrane, a filtration sieve, or a filtration net.

In at least one embodiment, the floatable structure 104 may include a floating support member 118 attached to the body 108 of the floatable structure 104. The floating support member 118 may be an inflatable structure and may help the floatable structure 104 to stay afloat while the floatable structure 104 gains weight as it holds the aggregate 106*a* and/or water inside the storage space 112. The floating support member 118 may be disposed selectively at certain locations of the body 108 so as to balance the floatable structure 104 in tidal conditions. In certain instances, the floating support member 118 may be initially in a deflated state. In cases where the water level rises beyond a set mark as the floatable structure 104 gains weight, the floating support member 118 may be inflated to ensure that the floatable structure 104 stays afloat while being at least partially immersed in the water body 106. Examples of the floating support member 118 may include, but is not limited to, a rubber structure, an inflatable bag, a plastic member, a foam-based structure, an aerogel-based structure, and a wooden structure.

The apparatus 102 may further include the control assembly 120 coupled to the body 108 of the floatable structure 104. The control assembly 120 may be configured to control the collection of the aggregate 106*a* present in the water body 106, into the storage space 112 through the opening 114. The control of the collection may correspond to a control of one or more of a rate, an aggregate volume, an aggregate size, or an aggregate weight. Such collection of the aggregate 106*a* may be controlled when the floatable structure 104 is at least partially immersed in the water body 106. The control assembly 120 may include a suitable implement to attract or pull the aggregate 106*a* floating around the floatable structure 104, into the storage space 112. As an example, the suitable implement may be a suction pump that may be configured to create a vortex of water in or around the floatable structure 104 and thereby, may pull-in the aggregate 106*a* to the storage space 112, through the opening 114. While the aggregate 106*a* is pulled inside the storage space 112, additional water may also enter in the storage space 112. In such instances, the control assembly 120 may retain the aggregate 106*a* while flushing-out the additional water from the storage space 112 back to the water body 106. Such a flush-out may be performed based on use of the filter structure 116 and a suitable push-out implement, such as a gravity fed push-out implement, or an ejection pump.

Figure 2:
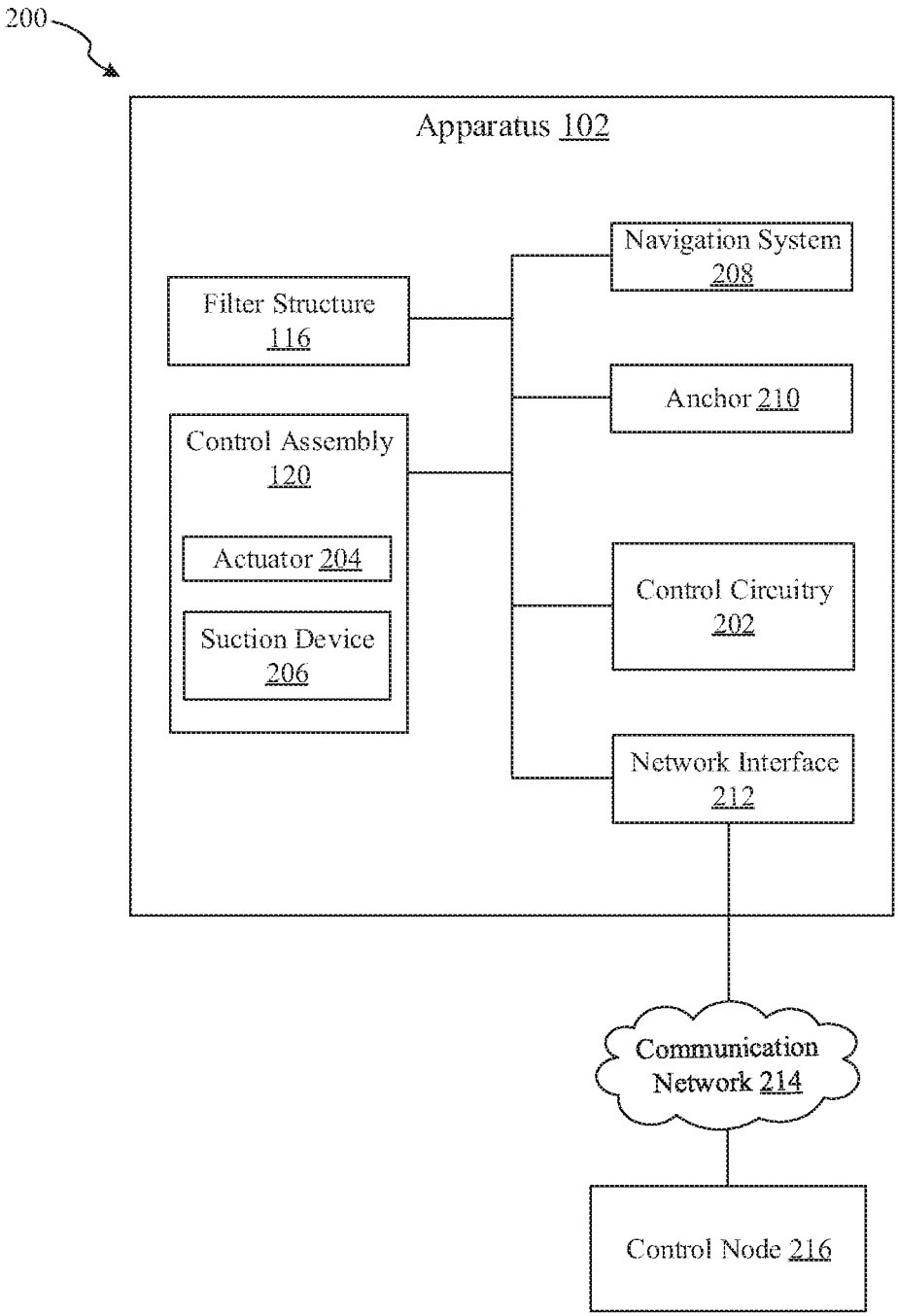
FIG. 2 illustrates a block diagram of an exemplary apparatus for collection of an aggregate from a water body, in accordance with an embodiment of the disclosure.

FIG. 2 illustrates a block diagram of an exemplary apparatus for collection of an aggregate from a water body, in accordance with an embodiment of the disclosure. FIG. 2 is explained in conjunction with elements from FIG. 1. With reference to FIG. 2, there is shown a block diagram 200 of the apparatus 102. The apparatus 102 may include the floatable structure 104 and the control assembly 120. The floatable structure 104 may include the body 108, the storage space 112, the opening 114, and the filter structure 116. The control assembly 120 may include a control circuitry 202, an actuator 204, and a suction device 206. The apparatus 102 may further include a navigation system 208, an anchor 210, and a network interface 212. As further shown in FIG. 2, the network interface 212 may facilitate communication through a communication network 214, with other external communication device, for example, a control node 216.

The control circuitry 202 may execute program instructions to control different operations of the apparatus 102. Some of the operations may include, for example, battery charge management, communication of aggregate collection information to various nodes, control of tools (such as propellers, air pumps, water pumps, or the suction device 206) for aggregate collection, navigation controls (e.g., using the actuator 204), and the like. The control circuitry 202 may include one or more specialized processing units, which may be implemented as a separate processor. In an embodiment, the one or more specialized processing units may be implemented as an integrated processor or a cluster of processors that perform the functions of the one or more specialized processing units, collectively. Examples of specialized processing units may be an X86-based processor, a Graphics Processing Unit (GPU), a Reduced Instruction Set Computing (RISC) processor, an Application-Specific Integrated Circuit (ASIC) processor, a Complex Instruction Set Computing (CISC) processor, a microcontroller, a central processing unit (CPU), and/or other control circuits.

The actuator 204 may be configured to control the movement of the floatable structure 104 in the water body 106. The movement of the floatable structure 104 may be one of a translation, a rotation, or a combination thereof. Although there is shown only one actuator 204 in the block diagram 200; however, in some embodiments, more than one actuator may be used to control the movement of the floatable structure 104, without any deviation from the scope of the disclosure. Examples of the actuator 204 may include, but is not limited to, an outboard motor, an inboard motor, a rotary actuator, or a linear actuator.

The suction device 206 may be configured to control the collection of the aggregate 106*a* into the storage space 112 of the body 108. The suction device 206 may include a suction pump that may pull-in the aggregate 106*a* from the water body 106 towards the storage space 112 and an ejection pump that may push-out additional water collected in the storage space 112 while the aggregate 106*a* is being sucked. Alternatively, without using an ejection pump, an exit channel may be provided on the floatable structure 104 to remove the additional water collected in the storage space 112 by gravity.

The navigation system 208 may include suitable logic, circuitry, and/or interfaces that may be configured to control a route of the floatable structure 104 in the water body 106. The navigation system 208 may include a geo-positioning system, for example, a Global Navigation Satellite System (GNSS) or a Hybrid Navigation System, to determine a current location of the floatable structure 104 and to monitor changes in the current location as the floatable structure 104 moves along the route.

The network interface 212 may include suitable logic, circuitry, and interfaces that may be configured to facilitate communication between the control assembly 120 and nodes in a communication range of the control assembly 120. The network interface 212 may be implemented by use of various known technologies to support wired or wireless communication of the control assembly 120 with the communication network 214. The network interface 212 may include, but not limited to, an antenna, a radio frequency (RF) transceiver, one or more amplifiers, a tuner, one or more oscillators, a digital signal processor, a coder-decoder (CODEC) chipset, a subscriber identity module (SIM) card, or a local buffer circuitry.

The network interface 212 may be configured to communicate via wireless communication with networks, such as the Internet, an Intranet or a wireless network, such as a cellular telephone network, a wireless local area network (LAN), and a metropolitan area network (MAN). The wireless communication may be configured to use one or more of a plurality of communication standards, protocols and technologies, such as Global System for Mobile Communications (GSM), Enhanced Data GSM Environment (EDGE), wideband code division multiple access (W-CDMA), Long Term Evolution (LTE), code division multiple access (CDMA), time division multiple access (TDMA), Bluetooth, Wireless Fidelity (Wi-Fi) (such as IEEE 802.11a, IEEE 802.11b, IEEE 802.11g or IEEE 802.11n), voice over Internet Protocol (VoIP), light fidelity (Li-Fi), Worldwide Interoperability for Microwave Access (Wi-MAX), a protocol for email, instant messaging, and a Short Message Service (SMS).

The communication network 214 may include a communication medium through which the apparatus 102 and various nodes, such as the control node 216, may communicate with each other. The communication network 214 may be one of a wired connection or a wireless connection Examples of the communication network 214 may include, but are not limited to, the Internet, a cloud network, a Wireless Fidelity (Wi-Fi) network, a Personal Area Network (PAN), a Local Area Network (LAN), or a Metropolitan Area Network (MAN).

The communication network 214 may be established in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), device to device communication, cellular communication protocols, and Bluetooth (BT) communication protocols.

The control node 216 may include suitable logic, circuitry, and/or interfaces that may be configured to remotely control the floatable structure 104. Examples of the control node 216 may include, but not limited to, a ship, a beacon, a control center on a port, a smartphone, or any computing device with a communication capability. In some embodiments, there may be a chain of control nodes that may communicate with the apparatus 102 via the communication network 214. The chain of control nodes may even communicate between each other through the communication network 214 to transfer the operational information.

Figure 3A:
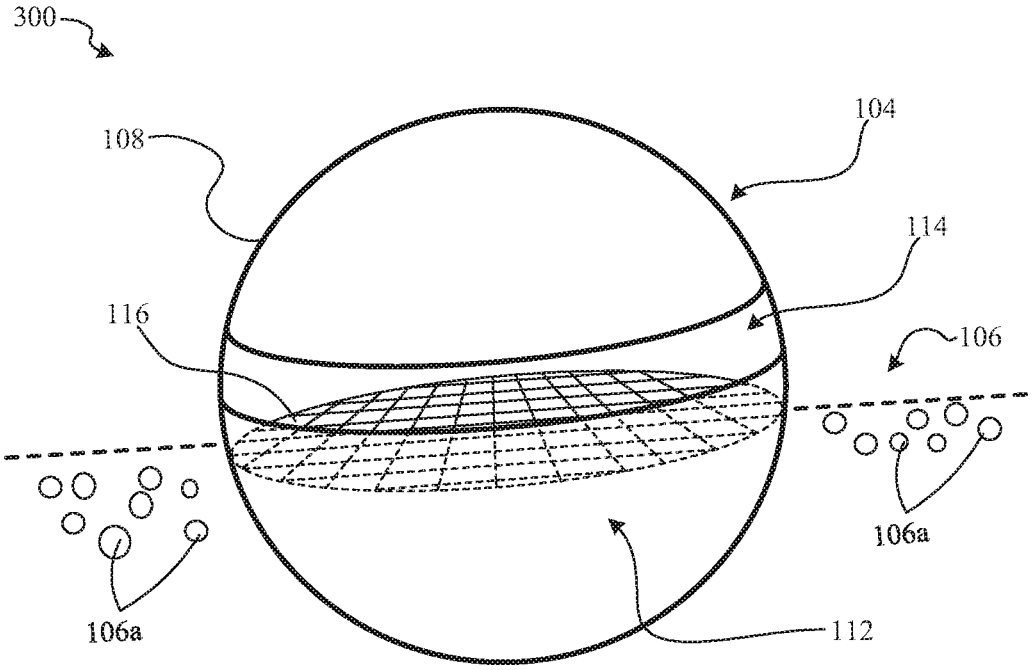
FIGS. 3A and 3B, collectively, illustrate an exemplary scenario for collection of an aggregate from a water body, in accordance with an embodiment of the disclosure.
Figure 3B:
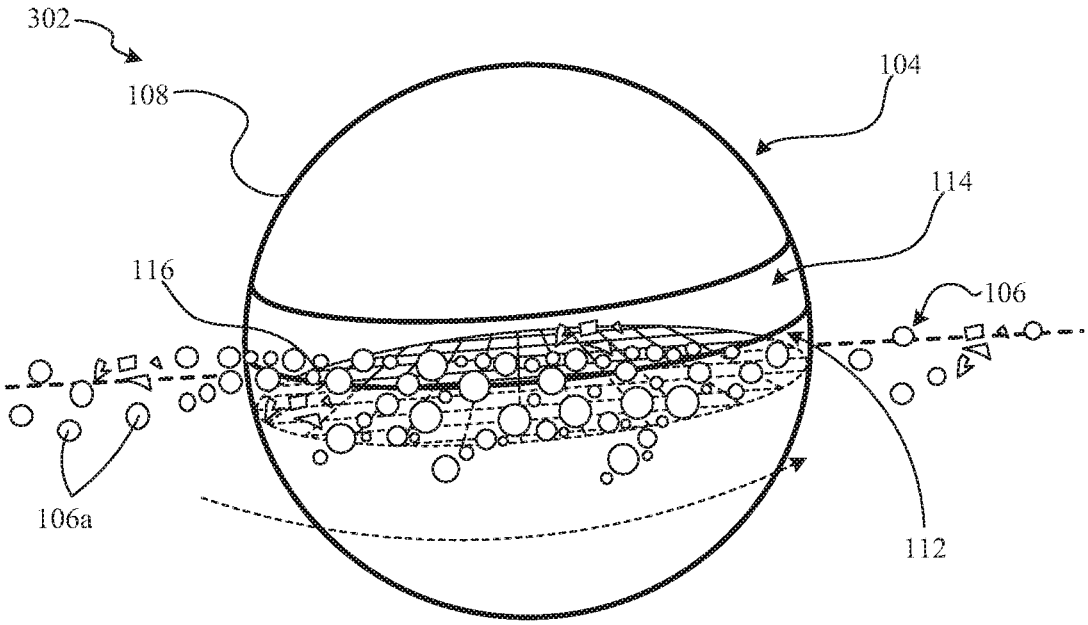

FIGS. 3A and 3B, collectively, illustrate an exemplary scenario for collection of an aggregate from a water body, in accordance with an embodiment of the disclosure. FIGS. 3A and 3B are explained in conjunction with elements from FIGS. 1, and 2. With reference to FIGS. 3A and 3B, there is shown an inactive operational state 300 and an active operational state 302 of the apparatus 102.

In the inactive operation state 300, the floatable structure 104 is shown to be at least partially immersed in the water body 106 and is allowed to remain in the state till a target amount of the aggregate 106*a* is detected to be accumulated around the floatable structure 104. The aggregate 106*a*, for example, aggregate of plastics, may be accumulated in the form of a patch around the floatable structure 104.

In the active operational state 302, the control assembly 120 may be configured to control the collection of the aggregate 106*a* present in the water body 106, into the storage space 112 through the opening 114. Such a control may correspond to a control of one or more of a rate (e.g., in ounces/hour), an aggregate volume, an aggregate size, or an aggregate weight (100 ounces). In at least one embodiment, the control assembly 120 may be also responsible for control of the movement of the floatable structure 104 when the floatable structure 104 is at least partially immersed in the water body 106. The movement of the floatable structure 104 may be one of a translation, a rotation, or a combination thereof.

The control circuitry 202 may control the actuator 204 to rotate the floatable structure 104 so that the aggregate 106*a* present in the water body 106 gets attracted and pulled-in through the opening 114. Alternatively, the control circuitry 202 may control the suction device 206 to pull-in the aggregate 106*a* from the water body 106 towards the storage space 112. Also, an ejection pump may be controlled to push-out additional water collected in the storage space 112 while the aggregate 106*a* is being pulled-in. Without using the ejection pump, an exit channel may be provided on the floatable structure 104 to remove the additional water collected in the storage space 112 by gravity. In certain instances, as the aggregate 106*a* is pulled-in via the opening 114 along with the additional water, the floatable structure 104 may employ the filter structure 116 to filter out additional water that is pulled-in along with the aggregate 106*a* and collect the aggregate 106*a* in the storage space 112.

Some additional embodiments related to movement control of the floatable structure 104 are described herein. The control circuitry 202 may configure the navigation system 208 to set a first route for navigation of the floatable structure 104. The control circuitry 202 may further configure the actuator 204 to control the movement of the floatable structure 104 in the water body 106 based on the first route set by the navigation system 208. In some instances, to protect the floatable structure 104 against waves that attempt to move the floatable structure 104 from the first route, the anchor 210 releasably coupled to the floatable structure 104 may be released into the water body 106. The control assembly 120 may be configured to release the anchor 210 from the floatable structure 104 into the water body 106 to limit the movement of the floatable structure 104 beyond a specific boundary. For example, the specific boundary may be determined based on an extent of the first route set by the navigation system 208. The anchor 210 may also help the floatable structure 104 to operate at locations where there may be a possibility of finding more aggregate.

At certain time instant, a fill level of the storage space 112 may need to be checked so as to decide whether to continue the collection of the aggregate 106*a* or to dump and repeat the collection process. In at least one embodiment, the control circuitry 202 may be configured to determine a fill level of the storage space 112 based on the collection of the aggregate 106*a* in the storage space 112. The control circuitry 202 may be further configured to compare the determined fill level with a defined threshold fill level. The defined threshold fill level may be based on a capacity limit for the storage space 112 or a safe limit above which the floatable structure 104 may likely drown from its weight.

The control circuitry 202 may be further configured to control the movement of the floatable structure 104 along a second route based on the comparison between the determined fill level and the defined threshold fill level. In cases where determined fill level equals the defined threshold fill level, the second route may include a dumping location and the control assembly 120 may be configured to move the floatable structure 104 to the dumping location to transfer the collected aggregate 106*a* from the storage space 112 to the dumping location. Thereafter, the floatable structure 104 may be moved to a different pick-up location of the aggregate 106*a*.

In certain scenarios, operations of the apparatus 102 may be remotely monitored by the control node 216. The control assembly 120 may be configured to communicate operational information to the control node 216 within a communication range of the control assembly 120, via the communication network 214. The operational information may include, for example, a current status of the collection and a current position of the apparatus 102.

The control assembly 120 may be further configured to receive a user input based on the communicated operational information. The user input may include, for example, a set of instructions to move the floating apparatus 102 or to control one or more of a rate of aggregate flow, an aggregate size, an aggregate volume, an aggregate weight for the collection of the aggregate 106*a*. For example, the control assembly 120 may configure the suction device 206 to control the rate of aggregate flow inside the storage space 112, or to set a mesh size of the filter structure 116 so as to allow the aggregate 106*a* of a particular aggregate size in the storage space 112. Additionally, or alternatively, the control assembly 120 may be configured to control the movement of the floatable structure 104 based on the received user input.

Figure 4:
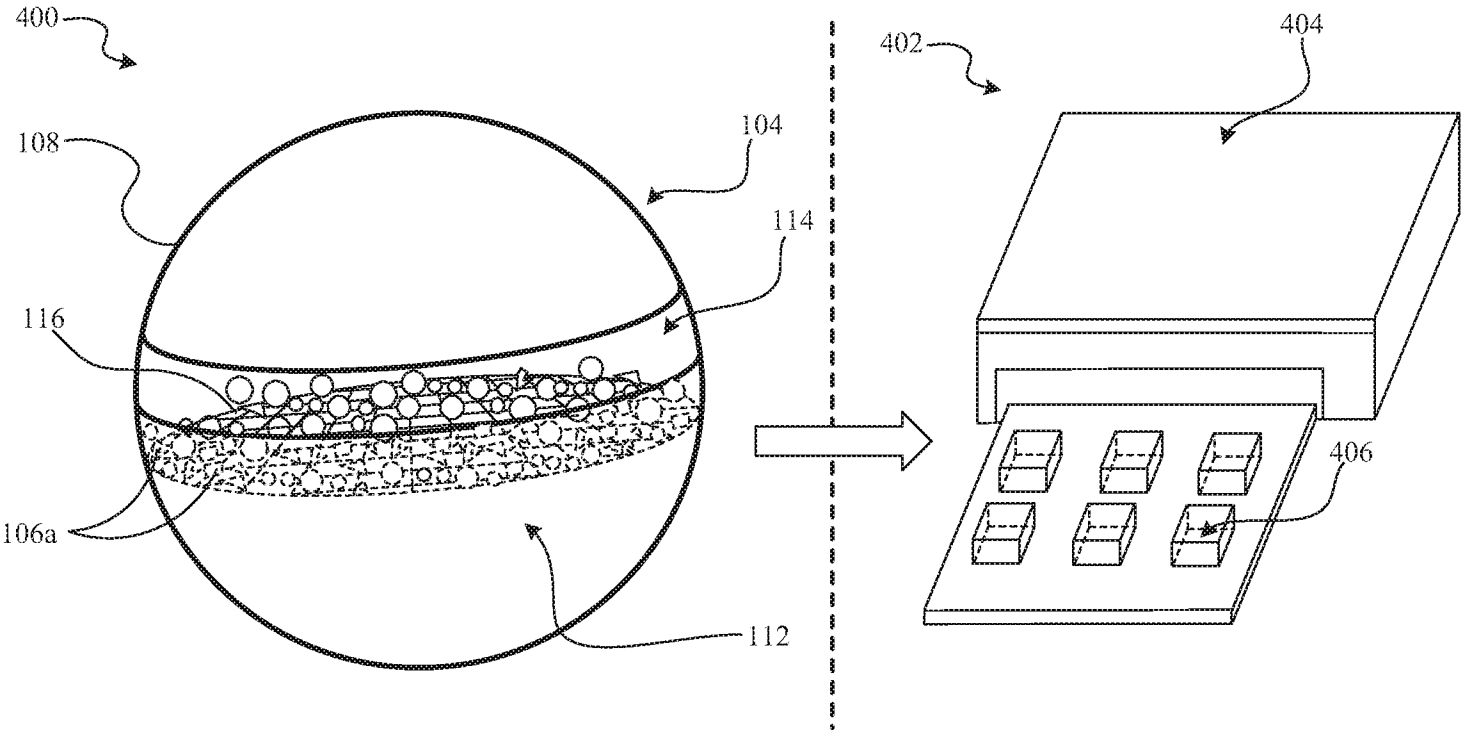
FIG. 4 illustrates an exemplary scenario for compaction of the aggregate collected by the apparatus of FIG. 1, in accordance with an embodiment of the disclosure.

FIG. 4 illustrates an exemplary scenario for compaction of the aggregate collected by the apparatus of FIG. 1, in accordance with an embodiment of the disclosure. FIG. 4 is explained in conjunction with elements from FIGS. 1, 2, 3A, and 3B. With reference to FIG. 4, there is shown a full state 400 of the apparatus 102 and a compaction state 402 of the aggregate 106*a* collected from operations of the apparatus, as described in FIGS. 1, 3A, and 3B.

In the full state 400, the storage space 112 of the apparatus 102 may be almost filled with the aggregate 106*a*, up to the defined threshold fill level. The aggregate 106*a* from the storage space 112 may be transferred to the dumping location that includes a compaction device 404. Examples of the compaction device 404 may include, but not limited to, a ramming device, a smooth wheeled roller, a vibrating plate compactor, and the like.

In the compaction state 402, the compaction device 404 may crush and compact the aggregate 106*a* to a compacted aggregate with a specific compaction structure for example, a brick or a sphere. Additionally, or alternatively, the compacted aggregate may be melted into blocks 406 after being crushed to pieces. Such blocks 406 may be used for several applications, such as, but not limited to, road construction, building construction, or other reusable products. The compaction device 404 shown in FIG. 4 is merely an example, and one skilled in the art may understand that any compaction device may be used to compact the aggregate 106*a*, without any deviation from the scope of the disclosure.

Figure 5:
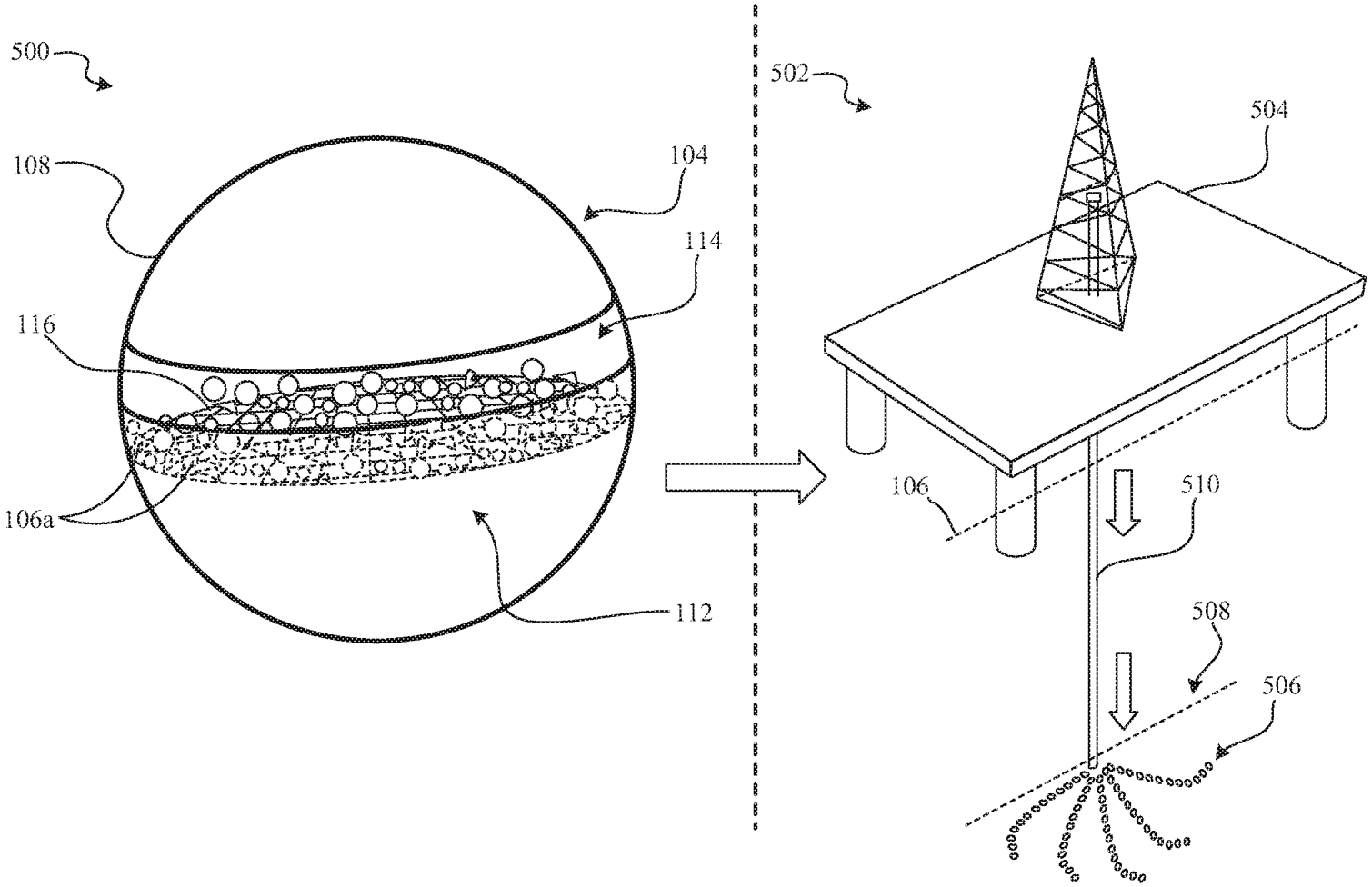
FIG. 5 illustrates an exemplary scenario for disposal of the aggregate collected by the apparatus of FIG. 1, in accordance with an embodiment of the disclosure.

FIG. 5 illustrates an exemplary scenario for disposal of the aggregate collected by the apparatus of FIG. 1, in accordance with an embodiment of the disclosure. FIG. 5 is explained in conjunction with elements from FIGS. 1, 2, 3A, 3B, and 4. With reference to FIG. 5, there is shown a full state 500 of the apparatus 102 and an injection state 502 of the aggregate 106*a*.

In the full state 500, the storage space 112 of the apparatus 102 may be almost filled with the aggregate 106*a*, up to the defined threshold fill level. The aggregate 106*a* from the storage space 112 may be transferred to the dumping location that includes a disposal rig 504, for example, a barge rig, an offshore rig, a land rig, a drill ship rig, and the like.

In the injection state 502, the aggregate 106*a* may be exposed to a specific temperature to produce a melted form 506 of the aggregate 106*a*. The melted form 506 of the aggregate 106*a* may be injected into ground 508 via use of a drill setup 510 on the disposal rig 504. Once injected, the aggregate 106*a* may be allowed to stay under the ground 508 and left to naturally decompose to oil over a long period of time. In certain exemplary scenarios, an abandoned offshore oil rig may be selected as the dumping location. The melted form of the aggregate 106*a* may be transferred via an oil drill and through the hole dug on the seabed to the ground 508. The disposal rig 504 shown in FIG. 5 is merely an example, and one skilled in the art may understand that any disposal rig may be used to dispose the aggregate 106*a*, without any deviation from the scope of the disclosure.

Figure 6:
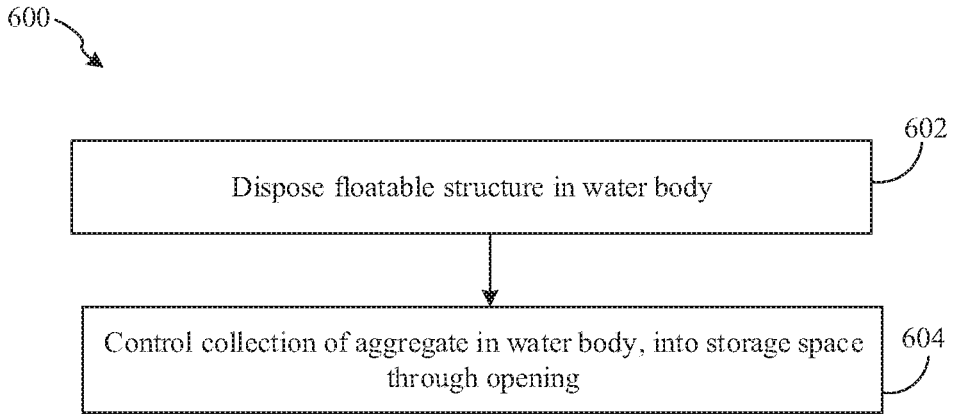
FIG. 6 illustrates a flowchart of an exemplary method for collection of an aggregate from a water body, in accordance with an embodiment of the disclosure.

FIG. 6 illustrates a flowchart of an exemplary method for collection of an aggregate from a water body, in accordance with an embodiment of the disclosure. FIG. 6 is explained in conjunction with elements from FIGS. 1, 2, 3A, 3B, 4, and 5. With reference to FIG. 6, there is shown a flowchart 600 that depicts a method for collection of the aggregate 106*a* from the water body 106. The method illustrated in the flowchart 600 may start from 602.

At 602, the floatable structure 104 may be disposed in the water body 106. The floatable structure 104 may include the body 108 that may have the substantially spherical surface and may include the storage space 112 within the substantially spherical surface of the body 108. The floatable structure 104 may also include the opening 114 that forms the passage to the storage space 112. Once disposed, the floatable structure 104 may stay afloat and at least partially immersed in the water body 106. Waste, for example, plastic objects, may accumulate as an aggregate around the floatable structure 104 over a time period.

At 604, the floatable structure 104 may be configured to control the collection of the aggregate 106*a* from the water body 106, into the storage space 112 through the opening 114. The collection may be controlled while the floatable structure 104 is partially immersed in the water body 106. The collection of the aggregate 106*a* is described, in detail, for example, in FIGS. 1, 2, 3A, and 3B. The flowchart 600 is illustrated as discrete operations, such as 602 and 604. However, in certain embodiments, such discrete operations may be further divided into additional operations, combined into fewer operations, or eliminated, depending on the particular implementation without any deviation from the scope of the disclosure.

For the purposes of the present disclosure, expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural. Further, all joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto. Additionally, the features of various implementing embodiments may be combined to form further embodiments.

What is claimed is:

1. An apparatus, comprising:

a floatable structure configured to be disposed in a water body, the floatable structure comprising:

a body having a substantially spherical surface and including a storage space within the body;

an opening in the body, wherein the opening is configured to form a passage to the storage space; and a filter structure configured to extend circumferentially in the storage space to allow an aggregate of a particular aggregate size in the storage space; and a control assembly coupled to the body, the control assembly is configured to set a mesh size of the filter structure to control a collection of the aggregate present in the water body, into the storage space through the opening and the filter structure of the set mesh size, wherein the collection is controlled when the floatable structure is at least partially immersed in the water body.

2. The apparatus according to claim 1, wherein the filter structure is one of a semi-permeable membrane or a selectively permeable membrane.

3. The apparatus according to claim 1, wherein the opening is a slit in the body.

4. The apparatus according to claim 1, wherein the body comprises a first hemispherical portion and a second hemispherical portion, and wherein the first hemispherical portion is coupled to the second hemispherical portion so as to form the substantially spherical surface.

5. The apparatus according to claim 1, wherein the control assembly comprises:

at least one actuator to control movement of the floatable structure, and a suction device to control the collection of the aggregate.

6. The apparatus according to claim 1, wherein the control assembly comprises at least one actuator to rotate the floatable structure along a vertical axis when the floatable structure is at least partially immersed in the water body.

7. The apparatus according to claim 1, wherein the control assembly is further configured to control a movement of the floatable structure when the floatable structure is at least partially immersed in the water body.

8. The apparatus according to claim 7, wherein the movement corresponds to one of a rotation of the floatable structure, a translation of the floatable structure, or a combination of the rotation and the translation.

9. The apparatus according to claim 7, wherein the control assembly is further configured to control the movement of the floatable structure based on a first route for navigation of the floatable structure on the water body.

10. The apparatus according to claim 9, wherein the control assembly is further configured to:

determine a fill level of the storage space based on the collection of the aggregate along the first route;

compare the determined fill level with a defined threshold fill level; and control the movement of the floatable structure along a second route based on the comparison.

11. The apparatus according to claim 10, wherein the second route comprises a dumping location, and wherein the control assembly is further configured to transfer the aggregate from the storage space to the dumping location.

12. The apparatus according to claim 1, further comprising an anchor, wherein the control assembly is further configured to release the anchor in the water body so as to limit a movement of the floatable structure beyond a specific boundary.

13. The apparatus according to claim 1, wherein the control assembly is further configured to:

communicate operational information to a control node within a communication range of the control assembly based on the collection of the aggregate, wherein the operational information comprises a current status of the collection and a current position of the apparatus; and receive a user input based on the communicated operational information.

14. The apparatus according to claim 13, wherein the control assembly is further configured to control a movement of the floatable structure based on the received user input.

15. The apparatus according to claim 13, wherein the control assembly is further configured to control the collection of the aggregate based on the received user input.

16. The apparatus according to claim 1, wherein the control of the collection corresponds to a control of one or more of a rate, an aggregate volume, or an aggregate weight.

17. A method, comprising:

disposing a floatable structure in a water body, the floatable structure comprising:

a body having a substantially spherical surface and including a storage space within the substantially spherical surface; and an opening on the body, wherein the opening is configured to form a passage to the storage space;

filtering an aggregate from the water body through a filter structure, wherein the filter structure is configured to extend circumferentially in the storage space to allow the aggregate of a particular aggregate size in the storage space;

set a mesh size of the filter structure to allow the aggregate of the particular aggregate size in the storage space; and controlling a collection of the aggregate in the water body, into the storage space through the opening and the filter structure of the set mesh size, wherein the collection is controlled when the floatable structure is at least partially immersed in the water body.

18. The method according to claim 17, further comprising controlling a movement of the floatable structure when the floatable structure is at least partially immersed in the water body.

* * * * *